United States Patent [19]

Jenkins et al.

[11] 4,226,490

[45] Oct. 7, 1980

[54] STABILIZING ARRANGEMENT FOR MOVABLY MOUNTED DRAWER OR RACK

[75] Inventors: Thomas E. Jenkins; Thomas M. Hahn; Donald S. Cushing, all of Louisville, Ky.

[73] Assignee: General Electric Company, Louisville, Ky.

[21] Appl. No.: 930,948

[22] Filed: Aug. 4, 1978

[51] Int. Cl.[2] ..... A47B 88/00

[52] U.S. Cl. ..... 312/331; 312/270; 312/311; 239/220

[58] Field of Search ..... 312/331, 347, 110, 311, 312/270, 351, 342; 239/220

[56] References Cited

U.S. PATENT DOCUMENTS

| | | | |
|---|---|---|---|
| 2,490,535 | 12/1949 | Minor | 312/270 |
| 2,556,456 | 6/1951 | Tompkins | 312/311 |
| 2,573,272 | 10/1951 | Petkwitz | 312/270 |
| 2,668,091 | 2/1954 | Clark | 312/270 |
| 2,929,565 | 3/1960 | Gibson | 239/220 |
| 3,312,515 | 4/1967 | Barker | 312/331 |
| 3,323,853 | 6/1967 | Stark | 312/331 |
| 3,402,975 | 9/1968 | Smith | 312/311 |
| 3,750,238 | 8/1973 | Tanner | 312/351 |
| 3,794,401 | 2/1974 | Dean et al. | 312/331 |

*Primary Examiner*—Victor N. Sakran
*Attorney, Agent, or Firm*—Radford M. Reams

[57] ABSTRACT

An arrangement for stabilizing the in and out movement of a dishwasher dishrack which produces a precise guidance of the rack during its movement, including a stabilizer axle mounted to the rack and extending normally to the direction of movement. Friction rollers are fixed at either end of the stabilizer axle, spring-biased into engagement with an interior surface of the dishwasher cabinet, the constrained simultaneous rotation of each wheel serving to precisely control the movement and attitude of the rack during in and out movement. The spring-bias also preloads the rack mounting components to provide a vertical stabilizing effect. The stabilizer axle is mounted to specially configured rear corner brackets, housing spring-biased plungers which rotatably mount the axle, while producing the upward biasing thereof.

12 Claims, 3 Drawing Figures

STABILIZING ARRANGEMENT FOR MOVABLY MOUNTED DRAWER OR RACK

BACKGROUND DISCUSSION

This invention concerns cabinet structures having storage compartments or members such as drawers or racks and mounted for translational movement in the cabinet and more particularly, a stabilizing arrangement for such movable storage compartments in which there is a tendency of the member to be skewed in the plane of movement upon the application of transverse forces to the direction of movement.

In mounting a drawer or other member mounted for relative translational movement with respect to a support structure, the member is generally mounted for in and out movement in the cabinet along a fixed line of movement and some means is provided for controlling the lateral orientation of the member during its movement. This lateral guidance, in the plane of movement, is commonly achieved by drawer guides which limit the degree of skew or tilt of the drawer occurring due to sideward directed components of the drawer pulling force. Such guide surfaces must provide some clearance in order to provide free movement, which degree increases with the decreasing degree of precision of the guides, and accordingly some looseness may be perceived in the opening and closing of the drawer. Such looseness may also create an increase in the degree of opening and closing effoct required in that the skew may produce jamming or relatively tight frictional drag greatly increasing the effort required in opening or closing the drawer.

Similarly, the drawer mounting components may include guides in which the lifting of the drawer during its in and out movement is controlled, and similarly the clearance usually provided for free movement allows some degree of looseness.

If the drawer is relatively heavy, the weight loading of the drawer is sufficient to provide adequate vertical stability of the drawer. However, for unloaded lightweight drawer structures, such as in dishwasher racks, the looseness both laterally and vertically produces an objectional sensation of sloppiness in moving the drawer in and out of the supporting cabinetry and other structure. While precision mounting components could substantially eliminate such looseness, in many applications the cost of precision components would be prohibitive, such as in mass-produced appliances.

In most front-loading dishwashers, there is provided dishracks which are movable into and out of the interior of the dishwasher cabinet in order to enable loading of the dishware items. Such racks are typically supported by means of simple individually mounted plastic rollers or guides mounted on the dishrack on the interior of the cabinet.

Simple roller mounting arrangements are necessitated both in the interests of minimizing manufacturing costs and also due to the fact that the interior cabinet is subjected to the washing water spray. Such simple support arrangements however result in a tendency for the rack to be skewed slightly upon uneven application of the pulling forces, creating a feeling of objectionable looseness to the person manipulating the rack.

U.S. Pat. No. 3,323,853 discloses a torque equalizing arrangement in which an axle shaft is provided, supported on rollers bearing the weight of the drawer. The axle shaft has pinion gears secured at either end to the axle shaft in engagement with gear racks located on the underside of the drawer. The torsional interconnection of the pinion gears defeats the tendency to skew. This arrangement, while basically achieving the anti-skew effect, involves a relatively elaborate structure, i.e., the pinion gears and rack, which would add considerably to the cost of manufacture of the drawer.

In addition, the bottom-mounting of the axle would not be suitable in upper dishwasher rack applications as it would interfere with the cleaning action of the dishwasher spray.

The lightweight characteristic of such dishwasher racks tends to produce a certain vertical looseness in the movement of the rack as well, since the rollers are only lightly loaded, which would not be alleviated by the arrangement disclosed in U.S. Pat. No. 3,323,853.

Accordingly, it is an object of the present invention to provide a motion stabilizer arrangement for members mounted for relative translational movement with respect to a supporting structure such as drawers or dishwasher racks mounted for in and out movement in a cabinet.

It is a further object of the present invention to provide a motion stabilizer arrangement which is adaptable for the upper rack of a dishwasher.

It is yet another object of the present invention to provide a motion stabilization arrangement which also vertically stabilizes the member in its movement by preloading the member such that lightweight racks may thereby be vertically stabilized in their movement.

SUMMARY OF THE INVENTION

These and other objects of the present invention, which will become apparent upon a reading of the following specification and claims, are accomplished by a stabilizing arrangement consisting of a rotatably supported axle, extending normally to the direction of motion of the movable member. Fixed to either end of the stabilizer axle is a pair of rollers, with the axle/roller assembly mounted so as to be resiliently urged into engagement with a planar surface parallel to the direction of movement to create a frictional engagement of the rollers with the surface, to thereby stabilize the movement of the member by the interconnection of the respective rollers tending to prevent any skewing of the member.

In the preferred embodiment, the arrangement is incorporated in a dishwasher upper rack mount and the stabilizer axle is mounted on the top rear portion of the rack urged upwardly into engagement with the interior top surface of the cabinet above the rack such as to provide a preloading of the components mounting the rack for in and out movement.

The mounting of the axle roller assembly includes corner brackets secured to the rear corners of the rack having spring-biased plungers slidably mounted in each of the corner brackets, which plungers receive the ends of the stabilizer axle so as to rotatably support the same while providing the biasing force necessary to urge the rollers into engagement with the interior top surface.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

The present invention consists of an arrangement for stabilizing the movement of a member which is mounted for relative translational movement on a supporting structure or which stabilizes the orientation and movement of the member throughout its movement, both laterally and vertically. The member is stabilized in such a manner as to substantially prevent the skewing or shift in orientation of the member as it is moved. In addition, the arrangement provides for a preloading such as to minimize vertical looseness to similarly stabilize the up and down motion of the unloaded lightweight member as it is moved in and out.

This arrangement, while having broad application to drawers or drawer-like members mounted for in and out movement in receiving cabinetry, has particular application to dishwasher upper rack installations since such arrangement is readily incorporated in dishwashers and also due to the relatively low costs involved, compatible with the manufacture of such appliances.

Accordingly, the following detailed description is in reference to a movably mounted dishwasher rack mounted for in and out translational movement with respect to the dishwasher cabinetry.

Figure 1:
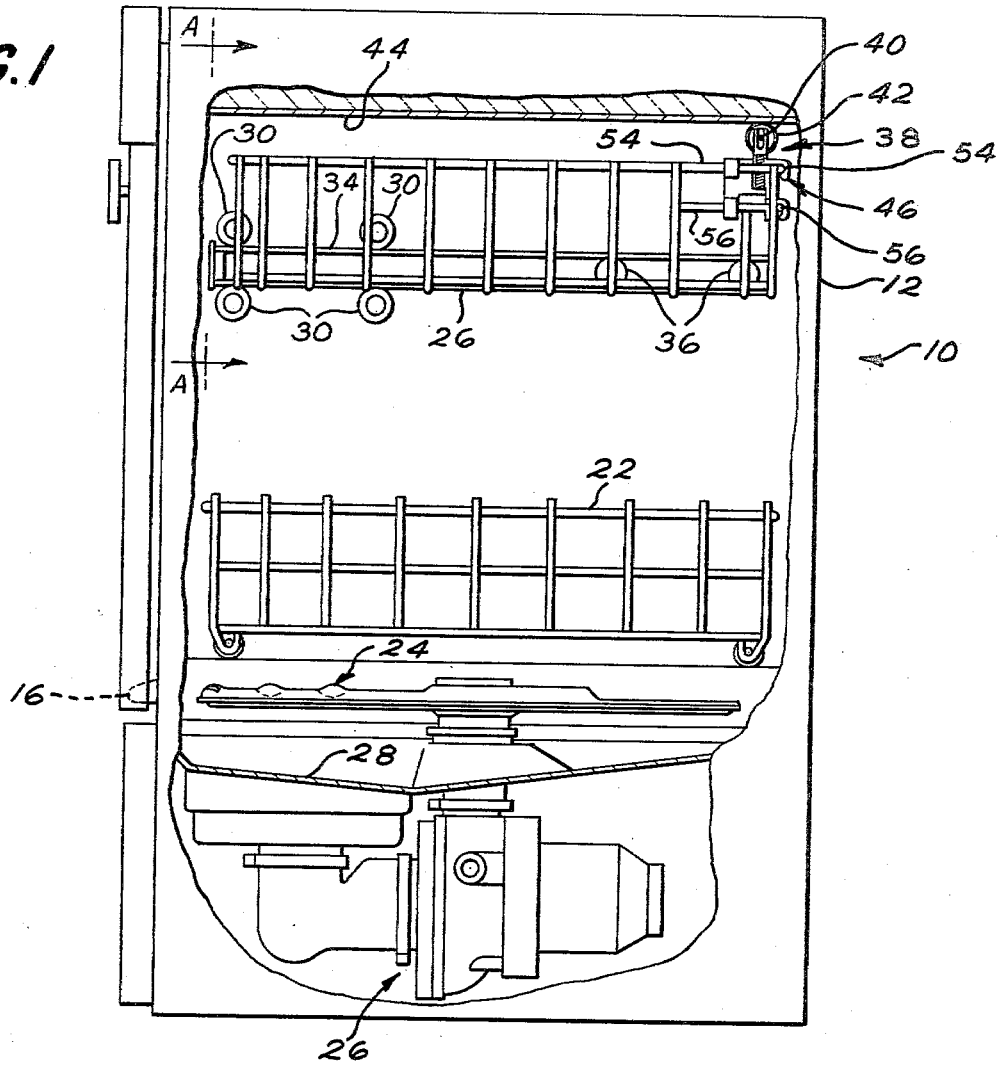
FIG. 1 is a side elevational view in partial section of a dishwasher incorporating a dishwasher rack provided with the motion stabilization arrangement according to the present invention.
Figure 2:
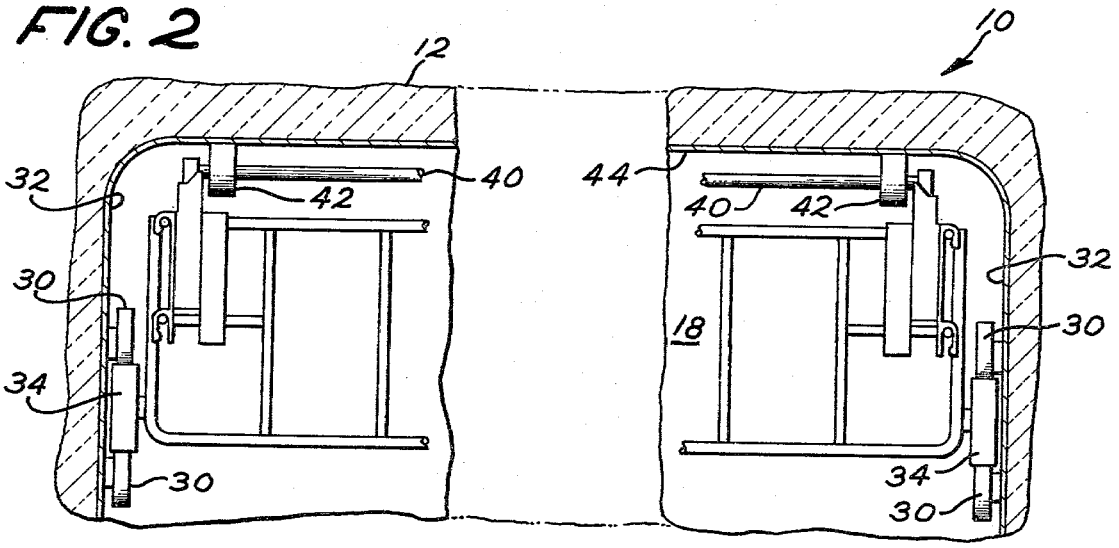
FIG. 2 is an enlarged view of the section A—A taken in FIG. 1.

Referring then to the drawings, FIGS. 1 and 2 depict a dishwasher 10 including a cabinet structure 12. Cabinet 12 includes a front opening access door 14 which is pivotally mounted at 16 so as to be swung down and away to provide access to the interior space 18 of the cabinet 12. Within the cabinet interior space 18 is mounted an upper rack 20 and a lower rack 22, which are suitably configured to receive the dishware items to be washed.

The washing action is conventionally achieved by a spray arm 24 which is adapted to be rotated and to direct a washing solution spray throughout the cabinet interior space 18, the interior of the arm supplied with wash water under pressure from a pump unit 26. The jet spray is collected in the tub 28 forming the bottom of the cabinet interior space 18 for recirculation and to be drained at the end of the wash and rinse cycles.

The motion stabilization arrangement is here applied to the upper rack 20, which is mounted for horizontal in and out movement with respect to the cabinet 12 and which in such movement is guided and supported by support means comprising a plurality of front rollers 30, mounted in the front region of the interior cabinet sidewalls 32 and guidebars 34 mounted to the upper rack 20. The rear of the upper rack 20 is supported by rollers 36.

The motion stabilization arrangement includes a stabilizer assembly 38 located at the rear of the upper rack 20. The assembly 38 includes a stabilizer axle 40 mounted to extend across the upper rear portion of the upper rack 20 so as to be disposed normally to the line of movement of the upper rack 20. Affixed to either end of the stabilizer axle 40 is a pair of equal diameter friction rollers 42 which are connected to the stabilizer axle 38 such as to be constrained to rotate together with each other and with the stabilizer axle 40.

The stabilizer axle 40 is mounted to the rear of the upper rack 20 for relative translational movement and is resiliently biased away from the upper rack 20 and upwardly by means which creates a frictional engagement of the friction rollers 42 with portions of the adjacent planar top surface 44 of the cabinet interior space 18. The top surface 44 is substantially planar and extends in a direction parallel to the direction of movement of the upper rack, such that it comprises a fixed guide surface engaged by the friction rollers 42. As noted, the stabilizer axle 40 extends across the rear of the upper rack 20 such that the direction of movement of the rack in and out of the cabinet interior space 18 is normal to the axis of rotation of the stabilizer axle 40.

The frictional engagement of the friction rollers 42 with the top surface 44 of the cabinet in effect constrains the direction of the in and out movement of the upper rack 20 to be that normal to the axis of rotation and since this is in alignment with the desired direction of movement, the rack motion is thereby controlled.

Any side loading on the upper rack 20 exerted by the pulling force tending to create a skewing or a change in orientation of the upper rack 20 as it undergoes the in and out movement is resisted by the driving connection between the friction rollers 42 in engagement with the relatively fixed guide surface defined by the top surface 44, unless the frictional forces are overcome.

Accordingly, this provides a lateral stabilization of the upper rack 20 as it undergoes its in and out movement which provides a motion stabilization to defeat any tendency to skew.

In addition, the downward reaction force exerted on the upper rack 20 by virtue of the resilient spring means urging the friction rollers 42 into engagement with the top surface 44 creates a preloading of the upper rack 20, forcing the upper rack 20 into engagement with the support means rollers 30 and 36 which absorb the reaction loading. This affords vertical stability by maintaining the upper rack 20 firmly in engagement with the rollers 30 and 36 even with the rack unfilled or unloaded. The overall net result is the precision and quality feel to the in and high out movement, while using relatively low cost components.

Figure 3:
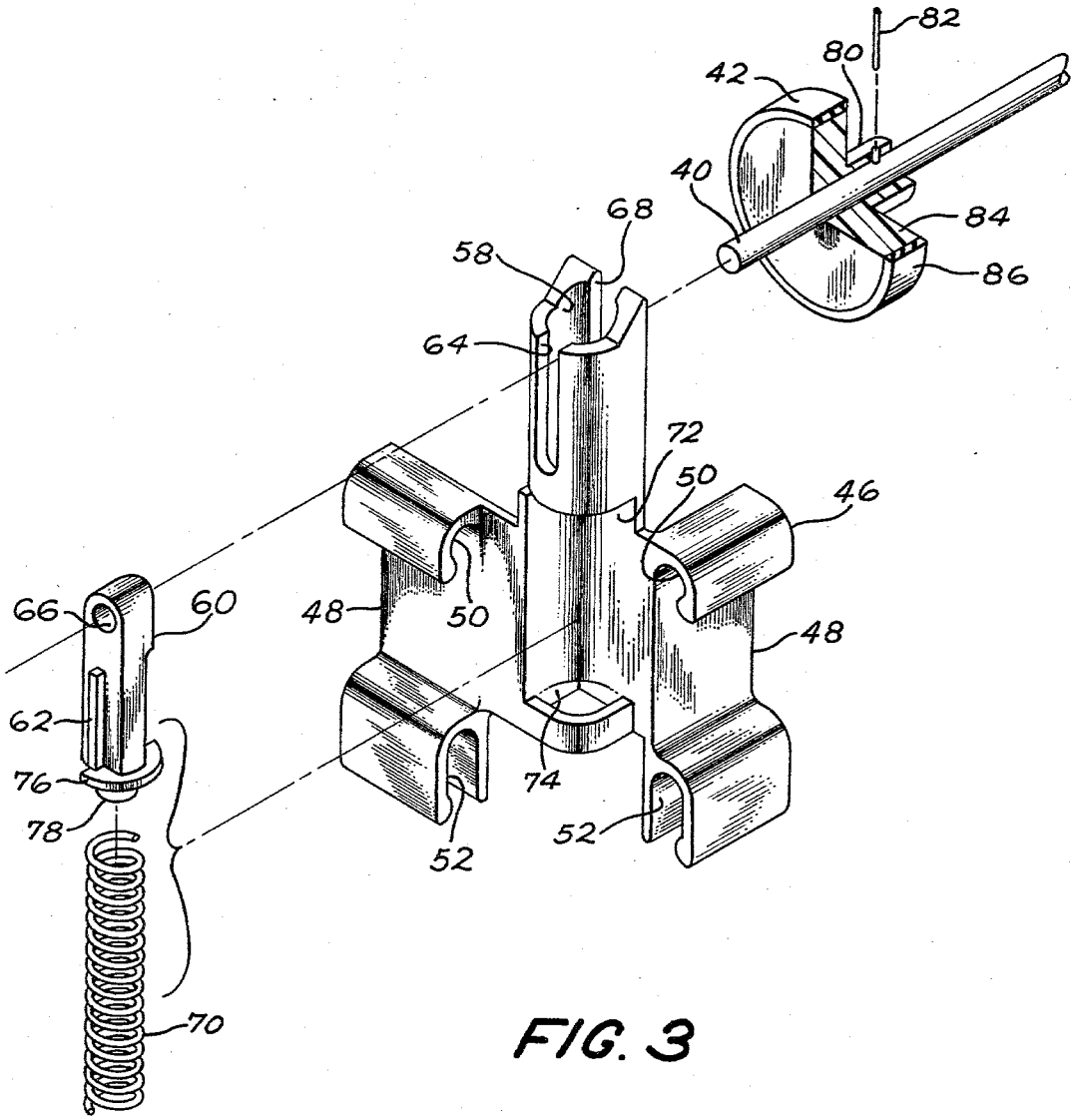
FIG. 3 is an exploded perspective view of the mounting components for the motion stabilization arrangement according to the present invention located on either side of the dishwasher rack.

Referring to FIG. 3, the arrangement for rotatably mounting the stabilizer axle 40 to the upper rack 20 and providing the upward bias force thereon includes a pair of corner brackets 46 having side sections 48 formed with wire form receiving recesses 50 and 52, which are configured to be passed over the wire form sections 56 and 54 (FIG. 1), so as to mount the corner brackets 46 thereto. Each corner bracket 46 is also provided with a socket 58 which is positioned at the corner of the corner bracket 46, adapted to receive a plunger 60 slidably fit therein with a key 62 extending out through a slot 64 such as to guide the movement and prevent turning of the plunger 60 in the socket 58.

Each plunger 60 is formed with a through hole 66 which is sized to receive the end of the stabilizer axle 40. The socket 58 is formed with a recess 68 to accommodate the stabilizer axle 40.

The upward biasing force is created by a compression spring 70 which is disposed in a space 72 intermediate the socket 58 and shoulder 74, formed in the space below the socket 58. Radial stop 76 limits the upward movement of the plunger 60 to maintain the socket 60 in position during assembly and upon removal of the rack from the cabinet interior space 18.

The pilot end section 78 guides the end of the compression spring 70 so as to keep the compression spring 70 in engagement therewith.

The details of the friction rollers 42 are also depicted in FIG. 3 and include a hub 80 in which a roll pin 82 extends through the hub and one end of the stabilizer axle 40. The friction rollers 42 may be constructed with a plastic core 84 with an outer resilient rubber material 86 to increase the coefficient of friction between the friction rollers 42 and the top surface 44, and also to cushion the rolling movement thereof to create a smoother feel.

Accordingly, it can be appreciated that only simple, low-cost components are required which nonetheless provide the controlled in and out movement of upper rack 20 to give a high quality precision "feel" to the rack due to the lateral and vertical stabilization afforded by the spring-biased stabilizer axle 40 and friction roller 42 assembly.

While this arrangement has been described in the context of a dishrack for dishwashers, it is of course applicable to other situations where a member is mounted to be movable in a fixed orientation with respect to a supporting structure such as in conventional cabinets and drawers. Many alternative variations are possible, such as the reversal of the relationship between the stabilizer axle member and the support structure, i.e., the axle may be fixed, and the rollers biased into engagement with a guide surface carried by the moving member.

The embodiments of the invention in which an exclusive property or privilege is claimed are defined as follows:

1. A motion stabilizing arrangement for a member mounted for guided relative translational movement with respect to a supporting structure along a fixed line of movement and in a fixed orientation with respect to said supporting structure, said arrangement including:

a stabilizer axle;

means rotatably mounting said stabilizer axle on said member, with said stabilizer axle extending in a direction normal to the line of movement of said member;

a pair of equal diameter friction rollers each connected to said stabilizer axle to rotate together therewith at spaced points along said stabilizer axle;

fixed guide surface means, including a surface portion disposed opposite each of said friction rollers on one side of said member and extending parallel to the line of movement of said member and the axis of said stabilizer axle;

means mounting said stabilizer axle for relative translational movement with respect to said member towards and away from said surface portions;

bias means acting on said stabilizer axle urging said friction rollers away from said member and into engagement with said fixed guide surface;

support means supporting the other side of said member during said translational movement and absorbing the reaction force created by said bias means;

whereby said friction rollers in engagement with said guide surface constrain said movement of said member along said line of direction in a fixed orientation with respect to said supporting structure and said support means is preloaded by said bias means.

2. The arrangement according to claim 1 wherein said bias means acting on said stabilizer axle urges said stabilizer axle in an upward direction and said member is mounted to move in a horizontal direction and wherein said fixed guide surface means surface portions are located above said member.

3. The arrangement according to claim 1 wherein said means movably mounting said stabilizer axle includes a pair of spaced plungers, each having an opening receiving one end of said stabilizer axle and wherein each of said plungers is mounted for sliding movement in said direction in which said axle is urged by said bias means, said bias means exerting a bias force on each of said pair of plungers.

4. The arrangement according to claim 3 wherein said bias means creating said bias force comprises a pair of compression springs, one each engaging a respective one of said pair of said plunger members.

5. The dishwasher according to claim 1 wherein said dishrack is supported for said movement in said interior space by a series of rollers supporting the dishrack on the lower portion thereof.

6. In a dishwasher of the type comprising an outer cabinet having an interior cabinet space including a horizontal top inner surface and further including at least one dishrack mounted in said cabinet interior space and wherein said dishrack is mounted for horizontal in and out movement within said interior cabinet space, in combination therewith:

a motion stabilizer arrangement for said dishrack comprising a stabilizer axle and means mounting said stabilizer axle to said dishrack for rotation and up and down translational movement towards and away from said top inner surface while extending normally to said direction of in and out movement;

bias means to produce a resilient force acting on said stabilizer axle to urge said friction rollers upwardly into engagement with said top inner surface of said interior cabinet space;

whereby said engagement of said friction rollers with said top inner surface as said dishrack undergoes said in and out movement stabilizes said rack with said in and out movement.

7. The dishwasher according to claim 5 wherein said means mounting said stabilizer axle to said dishrack comprises corner brackets affixed to the rear corners of said dishrack and means for rotatably mounting said stabilizer axle on said corner bracket.

8. The dishwasher according to claim 7 wherein said means for movably mounting said stabilizer axle further includes a pair of plungers, one each slidably supported in each one of said corner brackets and wherein each of said pair of plunger members is formed with an opening therein adapted to receive said stabilizer axle to be rotatably mounted therein.

9. The dishwasher according to claim 8 wherein said bias means resiliently urging said plunger upwardly comprises a pair of compression springs, one each engaging a respective one of said pair of plungers.

10. The dishwasher according to claim 9 wherein each of said plungers is slidably mounted in said corner bracket by means of a socket formed in each corner bracket and wherein each of said plungers is formed with a key and each of said sockets is formed with corresponding vertically extending slots, whereby said plungers are guided in said sockets by engagement of said keys with said slots to prevent turning and binding forces from being exerted on said stabilizer axle.

11. The dishwasher according to claim 10 wherein said stabilizer axle extends across the entire width of said dishrack and wherein said rollers are affixed at each end thereof to be spaced apart a distance substantially corresponding to the full width of said dishrack.

12. A motion stabilizing arrangement for a member mounted for relative translational movement with respect to a supporting structure along a fixed line of movement and in a fixed orientation with respect to said structure, said arrangement including:

a stabilizer axle;

means rotatably mounting said stabilizer axle on one of said member or said supporting structure, with said stabilizer axle extending in a direction normal to the direction of movement of said member;

a pair of friction rollers each connected to said stabilizer axle to rotate together therewith at spaced points along said stabilizer axle;

guide surface means including a planar guide surface portion on the other of said member or said supporting structure disposed opposite each of said friction rollers extending parallel to said direction of said line of movement of said member;

means mounting said stabilizer axle for relative translational movement with respect to said member towards and away from said surface portions;

means acting on said axle urging said friction rollers into engagement with a planar surface on the other of said member or said supporting structure;

support means supporting the other side of said member during said translational movement and absorbing the reaction force created by said bias means;

whereby said stabilizer axle and said friction rollers in engagement with said planar surface portions constrain said movement of said member along said line of direction in a fixed orientation with respect to said supporting structure and preloaded into said guide means.

* * * * *